US009999251B2

(12) United States Patent
Liu

(10) Patent No.: US 9,999,251 B2
(45) Date of Patent: Jun. 19, 2018

(54) ATOMIZATION ASSEMBLY AND ELECTRONIC CIGARETTE

(71) Applicant: KIMREE HI-TECH INC., Road Town, Tortola (VG)

(72) Inventor: Qiuming Liu, Shenzhen (CN)

(73) Assignee: HUIZHOU KIMREE TECHNOLOGY CO., LTD. SHENZHEN BRANCH, Shenzhen (CN)

( * ) Notice: Subject to any disclaimer, the term of this patent is extended or adjusted under 35 U.S.C. 154(b) by 0 days. days.

(21) Appl. No.: 15/322,316

(22) PCT Filed: Jun. 27, 2014

(86) PCT No.: PCT/CN2014/080988
§ 371 (c)(1),
(2) Date: Dec. 27, 2016

(87) PCT Pub. No.: WO2015/196466
PCT Pub. Date: Dec. 30, 2015

(65) Prior Publication Data

US 2017/0135403 A1 May 18, 2017

(51) Int. Cl.
*A24F 13/00* (2006.01)
*A24F 17/00* (2006.01)
(Continued)

(52) U.S. Cl.
CPC ..... *A24F 47/008* (2013.01); *H05B 3/03* (2013.01); *H05B 3/42* (2013.01); *H05B 2203/021* (2013.01)

(58) Field of Classification Search
CPC ..... A24F 47/00; A24F 47/002; A24F 47/008
(Continued)

(56) References Cited

U.S. PATENT DOCUMENTS

2014/0182610 A1* 7/2014 Liu ..... A24F 47/008 131/329
2014/0209105 A1* 7/2014 Sears ..... A24F 47/008 131/328
(Continued)

FOREIGN PATENT DOCUMENTS

CN 201072979 Y 6/2008
CN 103504478 A 1/2014
(Continued)

OTHER PUBLICATIONS

International Search Report (ISR) issued by the State Intellectual Property Office of the Peoples Republic of China on Mar. 27, 2015 for PCT/CN2014/080988, China.

*Primary Examiner* — Abdullah Riyami
*Assistant Examiner* — Thang Nguyen
(74) *Attorney, Agent, or Firm* — Tim Tingkang Xia, Esq.; Locke Lord LLP

(57) ABSTRACT

An electronic cigarette, comprising an atomization assembly for atomizing e-liquid and a battery assembly for supplying power to the atomization assembly; the battery assembly comprises a battery sleeve, a battery provided in the battery sleeve, an end cover provided on one end of the battery sleeve and a control module, the battery is connected electrically to the control module; a fastening sleeve and a battery electrode assembly for connecting electrically with the atomization electrode are provided on the other end of the battery sleeve; the battery electrode assembly comprises a battery electrode connected electrically with the atomization electrode, an insulating cover for isolating the battery electrode from outside electrically, an elastic member for elastically connecting the battery electrode and the insulating cover; an accommodation space is provided in the
(Continued)

insulating cover, the battery electrode is provided compressibly in the accommodation space via the elastic member.

3 Claims, 6 Drawing Sheets

(51) Int. Cl.

| | |
|---|---|
| ***A24F 25/00*** | (2006.01) |
| ***A24F 47/00*** | (2006.01) |
| ***H05B 3/03*** | (2006.01) |
| ***H05B 3/42*** | (2006.01) |

(58) Field of Classification Search
USPC ..... 131/329
See application file for complete search history.

(56) References Cited

U.S. PATENT DOCUMENTS

| | | | | |
|---|---|---|---|---|
| 2015/0296884 | A1* | 10/2015 | Liu | A24F 47/008 131/329 |
| 2015/0296886 | A1* | 10/2015 | Li | A24F 47/008 131/329 |
| 2016/0106155 | A1* | 4/2016 | Reevell | A24F 47/008 131/329 |

FOREIGN PATENT DOCUMENTS

| | | | |
|---|---|---|---|
| CN | 203646500 | U | 6/2014 |
| CN | 203646508 | U | 6/2014 |
| CN | 204070535 | U | 1/2015 |
| KR | 101316347 | B1 | 10/2013 |

* cited by examiner

ATOMIZATION ASSEMBLY AND ELECTRONIC CIGARETTE

TECHNICAL FIELD

The present application relates to the field of electric heating products, and more particularly relates to an atomizing assembly and an electronic cigarette.

BACKGROUND

Electronic cigarettes on the market at present comprises an electronic cigarette that a battery assembly and an atomization assembly are detachably connected with each other, and a disposable electronic cigarette that the battery assembly and the atomization assembly share an outer sleeve, all the atomization assemblies of the electronic cigarettes comprise heating wire assemblies, when the electronic cigarettes are working, the heating members of the heating wire assemblies emit heat to atomize e-liquid to achieve an effect of producing smoke.

In the prior art as shown in FIG. 1, the atomization assembly comprises a connection member 1 for connecting to the battery assembly, an atomization core 2 for atomizing e-liquid, an e-liquid retaining member 3 for storing the e-liquid and an atomization sleeve 4 sleeved outside the e-liquid retaining member 3.

Because the electronic cigarettes imitate maximally real cigarettes in shape, size and weight, in order to make users easy to accept, the atomization sleeve need to imitate the softness of real cigarettes to improve the users' experience; in this case, the hardness of the battery sleeve and the atomization sleeve is usually low, causing that the battery sleeve, the connection member 1 and the atomization sleeve cannot be connected through common thread connection structures, thus the structure of the atomization assembly and the electronic cigarette need to be improved.

BRIEF SUMMARY

The technical problems to be solved are: in respond to the defects of the prior art, the present invention provides an atomization assembly and an electronic cigarette with light weight, soft and reliable stable structures.

The technical solutions of the present application for solving the technical problems are as follows: providing an atomization assembly, which is configured for assembling with an battery assembly to form an electronic cigarette, wherein the atomization assembly comprises a connection member for connecting to a battery assembly, an atomization core for atomizing e-liquid, an e-liquid retaining member for storing the e-liquid and made of oil absorption materials, and an atomization sleeve made of non-metallic material and able to be elastically deformed under an external force; the connection member comprises a first connection end for inserting into the atomization sleeve, and a second connection end for connecting to the battery assembly; a peripheral surface of an outer wall of the first connection end is provided with a knurled structure that prevents the atomization sleeve from falling off; a compression convex platform is provided between the first connection end and the second connection end; a recess extends along a periphery direction of a side of the compression convex platform; the atomization core comprises an atomization electrode for connecting to the battery assembly, an atomization core sleeve inserted into the e-liquid retaining member, a heating wire assembly electrically connected to the atomization electrode and defined in the atomization core sleeve, and a supporting member for reducing elastic deformation of the atomization assembly under the external force, the supporting member is inserted on an end of the atomization core sleeve opposite to the atomization electrode; the atomization assembly further comprises a protective sleeve sleeved over the atomization sleeve and a fastening ring made of metallic materials and used for fastening the atomization sleeve to the connection member, the fastening ring is positioned between the compression convex platform and the protective sleeve.

In the atomization assembly according of the present invention, the recess is positioned between the first connection end and the compression convex platform, a surface of the knurled structure is coated with a mucilage for improving bonding strength between the connection member and the atomization sleeve.

In the atomization assembly according of the present invention, one end of the fastening ring abuts on an annular end surface of the compression convex platform towards the protective sleeve, the other end of the fastening ring abuts against an end surface of the protective sleeve corresponding to the annular end surface.

In the atomization assembly according of the present invention, the knurled structure is a straight grain knurling, a twill knurling or an overlapping curve knurling structure.

In the atomization assembly according of the present invention, a smoke channel for smoke atomized by the heating wire assembly to flow is provided in the atomization core sleeve axially, a first outlet through-hole communicated with the smoke channel for the smoke to flow out is axially provided along the supporting member.

In the atomization assembly according of the present invention, the atomization assembly further comprises a suction nozzle cover for users to inhale smoke, the suction nozzle cover is provided on an end of the atomization sleeve away from the connection member, a second outlet through-hole for the smoke to flow through is provided on the suction nozzle cover, the smoke channel, the first outlet through-hole and the second outlet through-hole are communicated successively to form an airflow circulation channel.

In the atomization assembly according of the present invention, the atomization core further comprises an insulating base inserted in the connection member, an installation through-hole for accommodating the insulating base is provided on the connection member, a fixed convex platform formed by extending radially inward and configured for preventing the insulating base from coming loose is provide on an inner surface of the installation through-hole; the atomization electrode is fastened in the insulating base, the insulating base makes the atomization electrode be electrically isolated with the connection member.

In the atomization assembly according of the present invention, the atomization core further comprises an atomization base for improving stability of the atomization electrode, one end of the atomization base is sleeved in the connection member, the other end of the atomization base is inserted in the atomization core sleeve; a through-hole for the atomization electrode to go through is provide axially on the atomization base.

In the atomization assembly according of the present invention, the heating wire assembly comprises a heating wire connected electrically with the atomization electrode and an e-liquid guiding member providing e-liquid for the heating wire, the heating wire twines uniformly around the e-liquid guiding member; e-liquid guiding through-holes for the e-liquid guiding member to stretch out are provided on the atomization core sleeve, two ends of the e-liquid guiding member go through the e-liquid guiding through-holes and insert into the e-liquid retaining member to obtain e-liquid.

In the atomization assembly according of the present invention, the connection member is made of conductive materials and is connected electrically with the heating wire assembly.

The present invention further provides an electronic cigarette, comprising the atomization assembly for atomizing e-liquid and the battery assembly for supplying power to the atomization assembly above.

In the electronic cigarette according of the present invention, the battery assembly comprises a battery sleeve, a battery provided in the battery sleeve, an end cover provided on one end of the battery sleeve and a control module for controlling the atomization assembly to work, the battery is connected electrically with the control module; a fastening sleeve for connecting with the atomization assembly and a battery electrode assembly for connecting electrically with the atomization electrode are provided on the other end of the battery sleeve.

In the electronic cigarette according of the present invention, the control module comprises an airflow sensor provided in the end cover, the airflow sensor is triggered when sensing an inhaling of the user and controls the battery to supply power to the atomization assembly.

In the electronic cigarette according of the present invention, the connection member is made of iron, the fastening sleeve is made of magnetic materials which can attract the connection member and is configured for connecting the battery assembly with the atomization assembly through the adsorption force between the fastening sleeve and the connection member.

In the electronic cigarette according of the present invention, the connection member is made of conductive materials and is connected electrically with the heating wire assembly.

In the electronic cigarette according of the present invention, the battery electrode assembly comprises a battery electrode connected electrically with the atomization electrode, an insulating cover for isolating the battery electrode from outside electrically, an elastic member for elastically connecting the battery electrode and the insulating cover; an accommodation space is provided in the insulating cover, the battery electrode is provided compressibly in the accommodation space through the elastic member.

The beneficial effects of the atomization assembly and the electronic cigarette of the present invention are illustrated as follows: the atomization sleeve made of non-metallic material and able to be elastically deformed under an external force has light weight and simulates the soft feel of a real cigarette to improve the users' experience at the same time; the protective sleeve also made of non-metallic materials can prevent the atomization sleeve from damaging caused by abrasing or scratching by sharp instruments during using without affecting the elastic deformation of the atomization sleeve at the same time; the knurled structure makes the interference fit between the connection member and the atomization sleeve stronger, and increases the friction between the connection member and the atomization sleeve to prevent the connection member from falling off from the atomization sleeve, the non-metallic elastic atomization sleeve is sleeved on the connection member through the metallic fastening ring, not only the structure is compact, the connection is also stable and reliable, solving the problems of easily cracking and falling off of the non-metallic atomization when the non-metallic atomization sleeve is connected with the connection member; the recess is configured for accommodating the spare mucilage to prevent the mucilage from spilling over and affecting appearance of the atomization assembly, the recess is further configured for holding food grade silicone to prevent the e-liquid leaking, and the fastening ring is pressed tight by the cooperating between the recess and the compression convex platform at the same time, which effectively prevents the atomization sleeve from sliding outward to be damaged or to produce burr; the supporting member inserted in the atomization core can avoid the phenomenon of an e-liquid leakage when the atomization assembly is damaged under an extrusion force, or the deformation of the e-liquid retaining member is too large under the clamping force of oral cavity which makes the e-liquid be pressed out, thus the user can use any tissue in the oral cavity such as teeth to force on the electronic cigarette of the present invention when smoking, which improves the users' experience.

BRIEF DESCRIPTION OF THE DRAWINGS

The present application will be further described with reference to the accompanying drawings and embodiments in the following, in the accompanying drawings.

DETAILED DESCRIPTION OF THE PREFERRED EMBODIMENTS

To make the technical feature, objective and effect of the present application be understood more clearly, now the specific implementation of the present application is described in detail with reference to the accompanying drawings and embodiments.

Figure 1:
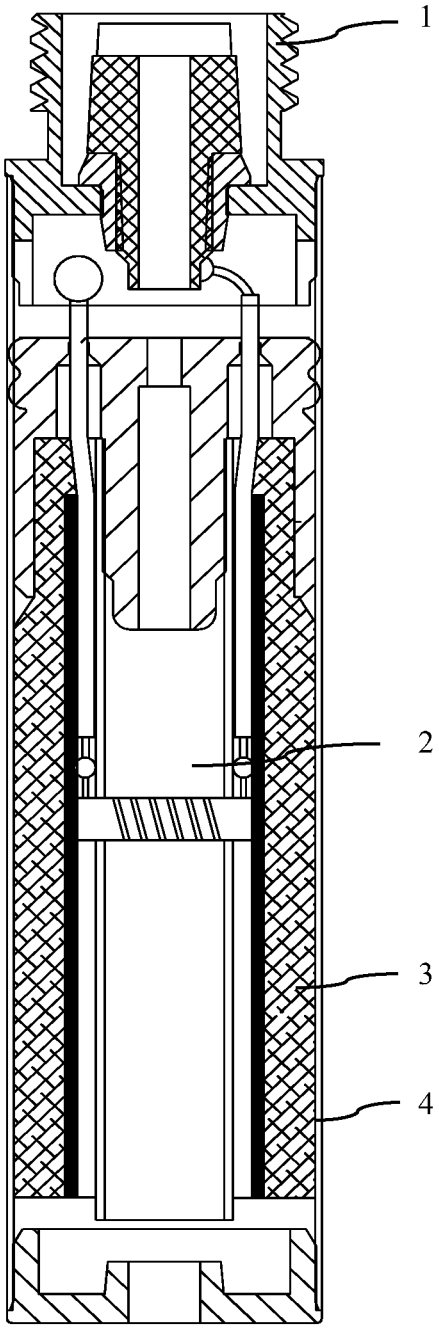
Fig. 1 (Prior Art)
FIG. 1 is a structural schematic view of an atomization assembly of the prior art.
Figure 2:
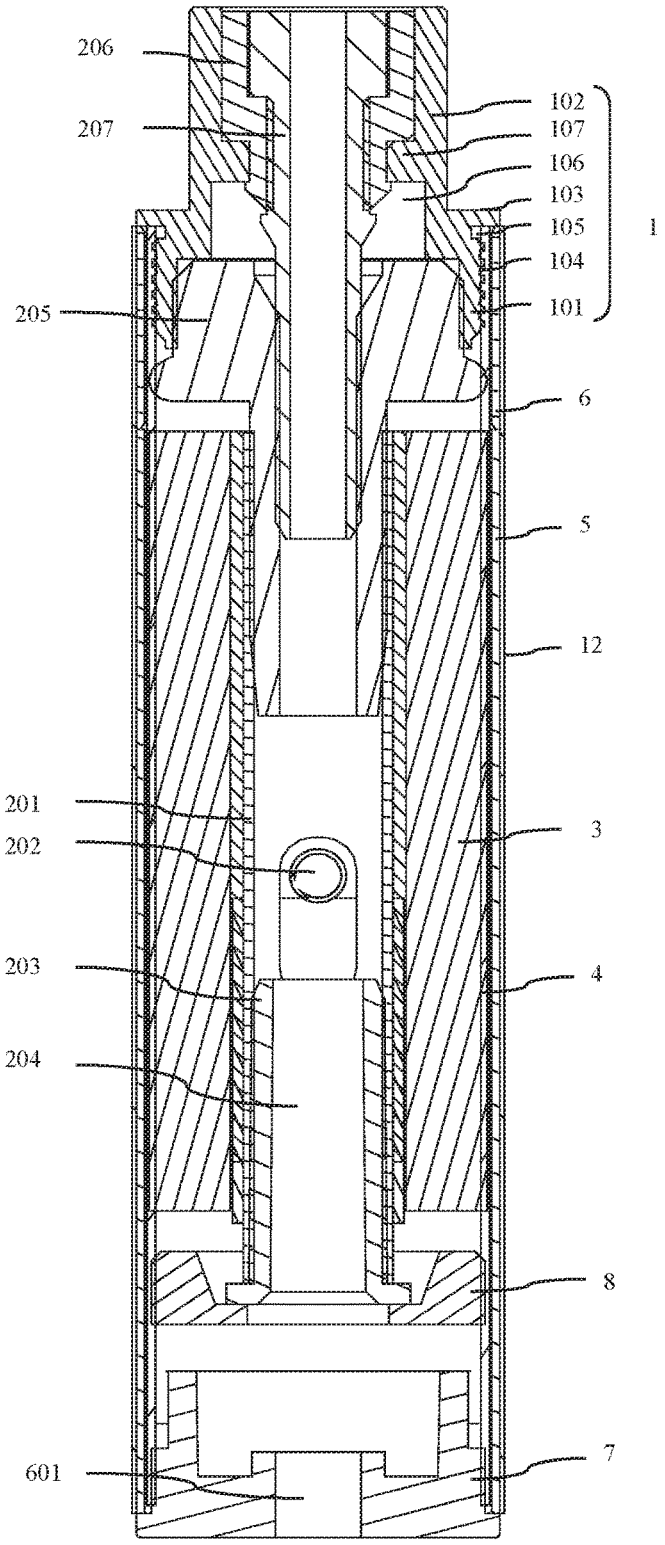
FIG. 2 is a structural schematic view of an atomization assembly of a preferred embodiment of present invention.

As shown in FIG. 2, the present invention provides an atomization assembly, which is configured for assembling with an battery assembly to form an electronic cigarette, the atomization assembly comprises a connection member 1 for connecting to a battery assembly, an atomization core 2 for atomizing e-liquid, an e-liquid retaining member 3 for storing the e-liquid and made of an oil absorption material, and an atomization sleeve 4 made of a non-metallic material and able to be elastically deformed under an external force.

In this embodiment, the atomization sleeve 4 is a hollow cylinder shape, and the connection member 1 is inserted in an end of the atomization sleeve 4, a suction nozzle cover 7 for user to inhale smoke is fixed in the other end of the atomization sleeve 4. A protective sleeve 5 and a fastening ring 6 are sleeved over the atomization sleeve 4, the fastening ring 6 is made of metallic material and used for compressing to fasten the atomization sleeve 4 to the connection member 1, the fastening ring 6 is positioned between the connection member 1 and the protective sleeve 5.

The atomization sleeve is a non-metallic soft sleeve which is able to be elastically deformed under the external force, such as a PC tube, a PETG tube, a PET tube, an ABS tube or a PP tube. The PC tube is a kind of polycarbonate plastic tubes, polycarbonate (PC) is a kind of amorphous thermoplastic resins with excellent comprehensive properties, it has admirable electrical insulation, extensibility, dimensional stability and chemical corrosion resistance, relative high strength, heat resistance up to 160 degrees and cold tolerance low to −60 degrees; it further has the advantages of self-extinguishing, flame retardant, nontoxic and can be colored and so on. PETG is a kind of transparent amorphous copolyester, it has the transparency as glass and good toughness, it is easy to form, and it belongs to environmental protection materials. PET is milky white or light yellow highly crystalline polymer, its surface is smooth and glossy, it has the features of creep resistance, fatigue resistance, rubbing resistance and small abrasion, and it has the largest toughness of thermoplastics. ABS is usually a light yellow or milk white non crystalline granular resin, ABS unifies organically the properties of PB, PAN and PS, ABS has excellent comprehensive physical and mechanical properties, excellent low temperature impact resistance; and dimensional stability. Electrical performance, wear resistance, chemical resistance, dyeing property, finished product processing and machining of the ABS are better, and the ABS is one of the most widely non-commonly used plastics. PP tube is polypropylene tube, polypropylene (PP) is a lighter plastic of common plastics, its electrical performance is excellent, it can be applied as a material with high frequency insulation resistance to hot and humid.

Thickness of the non-metallic soft sleeves above are controlled in a range of 0.15-0.25 mm, thus, it can effectively protect devices in the atomization sleeve 4 such as the e-liquid retaining member 3, the atomization core 2 and so on and a connection stability between the devices, and it simulates the soft touch sense of a real cigarette, thus improving the users' experience.

The protective sleeve 5 is configured for preventing the atomization sleeve 4 from damaging caused by abrasing or scratching by sharp instruments during using, if the atomization sleeve 4 is damaged, the e-liquid stored in the e-liquid retaining member 3 will leak out from a breakage, it may further cause instability of connections between the atomization sleeve 4, the connection member 1 and the suction nozzle cover 7 and a loosening phenomenon. In order to ensure the atomization sleeve 4 is able to be elastically deformed under the external force, the protective sleeve 5 is preferred to be a flexible tube made of wear resistant non-metallic materials.

Figure 3:
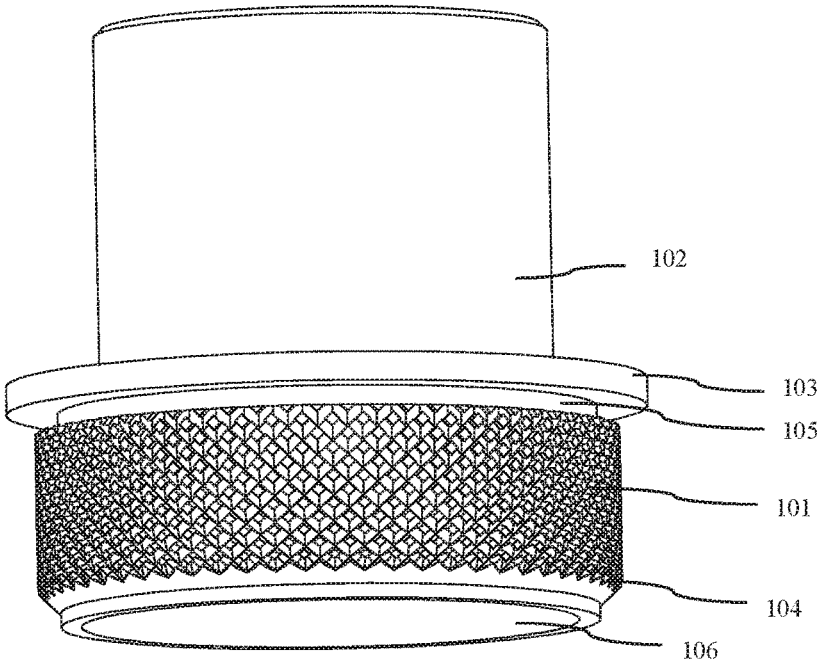
FIG. 3 is a three-dimensional structure of a connection member shown in FIG. 2.
Figure 4:
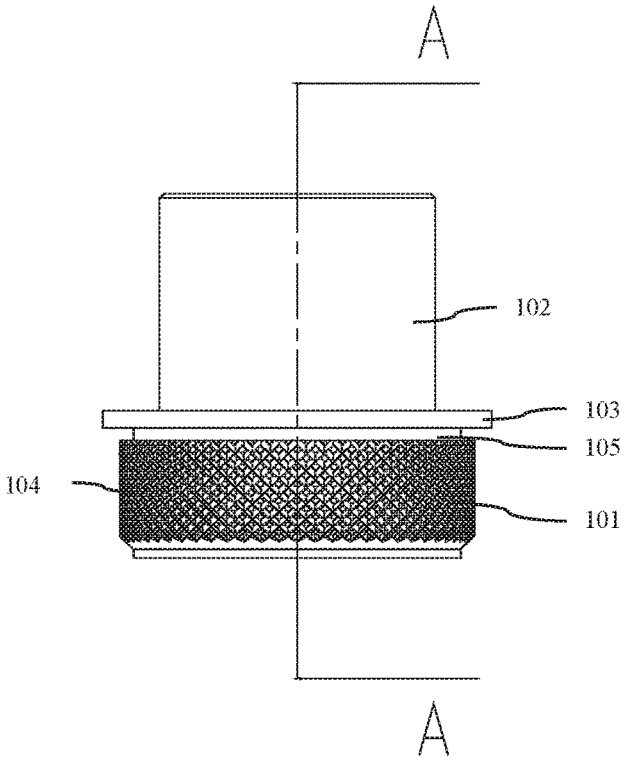
FIG. 4 is a front view of the connection member shown in FIG. 2.
Figure 5:
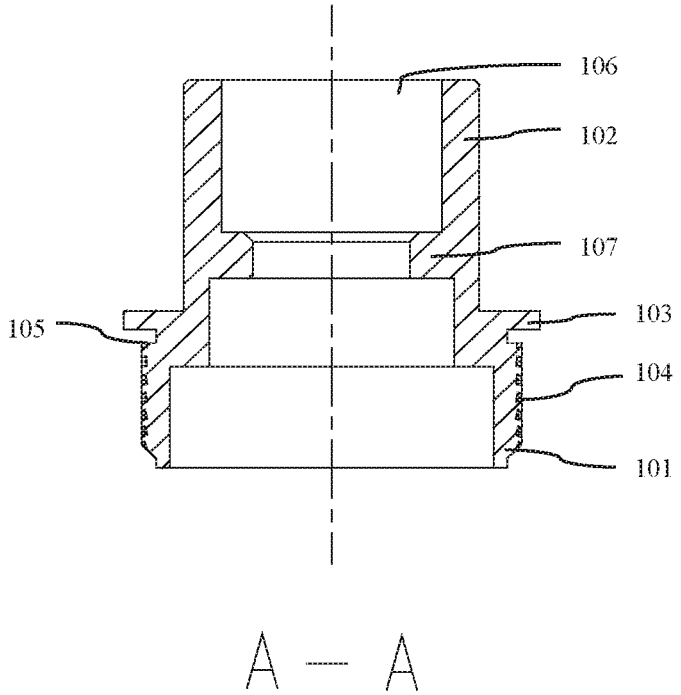
FIG. 5 is a section view of the connection member shown in FIG. 2 along a direction of A-A.

With a combination of the schematic view of the connection member 1 shown in FIG. 3, FIG. 4 and FIG. 5, it can be seen that, the connection member 1 comprises a first connection end 101 for inserting into the atomization sleeve 4, and a second connection end 102 for connecting to the battery assembly; a peripheral surface of an outer wall of the first connection end 101 abutting the atomization sleeve 4 is provided with a knurled structure 104, the knurled structure 104 can be a straight grain knurling, a twill knurling or an overlapping curve knurling structure, and so on. As the knurled structure 104 makes the peripheral surface of the outer wall of the connection member 1 be concave and convex shapes, which enables an interference fit between the connection member 1 and the atomization sleeve 4 to be stronger, and increases a friction between the connection member 1 and the atomization sleeve 4 to prevent the connection member 1 from falling off from the atomization sleeve 4.

Preferably, the knurled structure 104 is coated with a mucilage for improving bonding strength between the connection member 1 and the atomization sleeve 4, the mucilage forms a mucilage layer, a sunken of the first connection end 101 formed by the knurled structure 104 can accommodate a certain amount of the mucilage, which can prevent the mucilage from spilling over and affecting appearance of the atomization assembly, and the sunken can accommodate more mucilage to improve a stability between the connection member 1 and the atomization sleeve 4.

The connection member 1 is provided with a compression convex platform 103 which is convexly defined between the first connection end 101 and the second connection end 102, and a recess 105 extending along a periphery direction of a side of the compression convex platform 103, as shown in the three-dimensional view of FIG. 4, the compression convex platform 103 is also provided along a periphery direction of the connection member 1, and the recess 105 is positioned between the first connection end 101 and the compression convex platform 103. The recess 105 can further accommodate the mucilage above to make a spare mucilage or the mucilage spilling over between the knurled structure 104 and the atomization sleeve 4 accumulate in the recess 105, which prevents the mucilage from spilling over and affecting appearance of the atomization assembly. In addition, the recess 105 is further configured for holding food grade silicone to prevent the e-liquid leaking.

Figure 6:
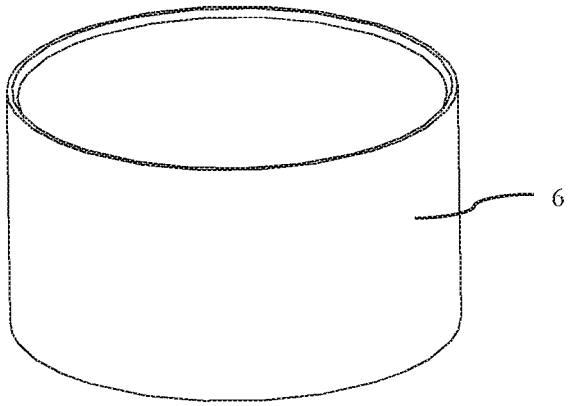
FIG. 6 is a three-dimensional structure of a fastening ring shown in FIG. 2.

With a combination of FIG. 6, a fastening ring 6 is a sleeve structure made of metallic materials, it is positioned between the compression convex platform 103 and the protective sleeve 5, one end of the fastening ring 6 abuts on an annular end surface of the compression convex platform 103 towards the protective sleeve 5, the other end of the fastening ring 6 abuts against an end surface of the protective sleeve 5 corresponding to the annular end surface, that is the fastening ring 6 is fixed by clamping the compression convex platform 103 and the protective sleeve 5.

Preferably, the fastening ring 6 and the atomization sleeve 4 are interference fitted, an inner surface of the fastening ring 6 presses the atomization sleeve 4 to make the atomization sleeve 4 be close to the knurled structure 104, to improve the friction between the atomization sleeve 4 and the first connection end 101. As the fastening ring 6 is made of metallic materials, it is not easily to be deformed during using and can keep abutting and pressing the atomization sleeve 4.

In addition, when installing the fastening ring 6, the fastening ring 6 tends to drive the atomization sleeve 4 to slide, the recess 105 can effectively prevent the atomization sleeve 4 from sliding outward to be damaged or to produce burr when the fastening ring 6 and the compression convex platform 103 are pressed tight.

Preferably, an inner surface of the protective sleeve 5 fits closely to the atomization sleeve 4, and an outer surface of the atomization sleeve 4 is completely covered by the protective sleeve 5 and the fastening ring 6 to prevent the atomization sleeve 4 from damaging. An axial length of the fastening ring 6 is larger than an axial length of the first connection end 101 to improve the friction between the atomization sleeve 4 and the first connection end 101.

The atomization assembly of the present invention further comprises a paster 12 coated on a peripheral surface of the protective sleeve 5 and the fastening ring 6, the paster 12 has a design and colors of the real cigarette to simulate the appearance and feel of the real cigarette to improve the users' experience; meanwhile, as a fastening effect of a viscous package of the paster 12, connection relationships between the atomization sleeve 4, the first connection end 101, the protective sleeve 5 and the fastening ring 6 are more stable. Understandably, the paster 12 can be a pulp paster similar to the real cigarette, and can also be a plastic paster and so on, specific designs and materials are not limited here, and a preferable thickness of the paster 12 is selected from one of 0.12-0.24 mm.

The atomization core 2 comprises an atomization electrode 207 for connecting electrically with the battery assembly, an atomization core sleeve 201 inserted in the e-liquid retaining member 3, a heating wire assembly 202 connected electrically to the atomization electrode 207 and provided in the atomization core sleeve 201, a supporting member 203 for reducing elastic deformation of the atomization assembly under the external force, an insulating base 206 inserted in the second connection end 102 and an atomization base 205 for improving a stability of the atomization electrode 207. An installation through-hole 106 throughout both sides of the connection member 1 is provided in the connection member 1, the installation through-hole 106 is configured for accommodating the insulating base 206 and the atomization electrode 207.

A smoke channel for smoke atomized by the heating wire assembly 202 to flow is provided in the atomization core sleeve 201 axially, the heating wire assembly 202 is provided in the smoke channel; the supporting member 203 is inserted on an end of the atomization core sleeve 201 which is opposite to the atomization electrode 207, a first outlet through-hole 204 communicated with the smoke channel for the smoke to flow out is provided along the supporting member 203; a fixed convex platform 107 formed by extending radially inward and configured for preventing the insulating base 206 from becoming loose is provide on an inner surface of the installation through-hole 106 to clamp the insulating base 206; the atomization electrode 207 is fixed in the insulating base 206 and is in an interference fit with an inner surface of the insulating base 206, and the insulating base 206 makes the atomization electrode 207 be electrically isolated with other devices; one end of the atomization base 205 is sleeved in the connection member 1, the other end of the atomization base 205 is inserted in the atomization core sleeve 201; a through-hole for the atomization electrode 207 to go through is provided on the atomization base 205.

Specifically, the heating wire assembly 202 comprises a heating wire connected electrically with the atomization electrode 207 and an e-liquid guiding member providing e-liquid for the heating wire, the heating wire twins uniformly around the e-liquid guiding member; e-liquid guiding through-holes for the e-liquid guiding member to stretch out are provided on the atomization core sleeve 201, two ends of the e-liquid guiding member go through the e-liquid guiding through-holes and insert into the e-liquid retaining member 3 to obtain the e-liquid. The e-liquid retaining member 3 can be made of materials such as cotton or fibers, it is not limited here.

Preferably, the connection member 1 is made of conductive materials and is connected electrically to the heating wire assembly 202, that is the connection member 1 is used as an electrode to supply power for the heating wire assembly 202, which can simplify the structure of the atomization assembly.

As the atomization sleeve 4 and the protective sleeve 5 of present invention are soft tubes made of non-metallic materials, when they are pressed by the external force, a protection to the components such as the internal atomization core 2 is limited, thus a supporting member 203 is needed to protect the atomization assembly, so as to avoid the e-liquid leakage phenomenon when the atomization assembly is damaged under an extrusion force.

In addition, the atomization assembly further comprises a suction nozzle cover 7 for user to inhale smoke, the suction nozzle cover 7 is provided on an end of the atomization sleeve 4 opposite to the connection member 1, a second outlet through-hole 601 for the smoke to flow through is provided on the suction nozzle cover 7, the smoke channel, the first outlet through-hole 204 and the second outlet through-hole 601 are communicated successively to form an airflow circulation channel.

Figure 7:
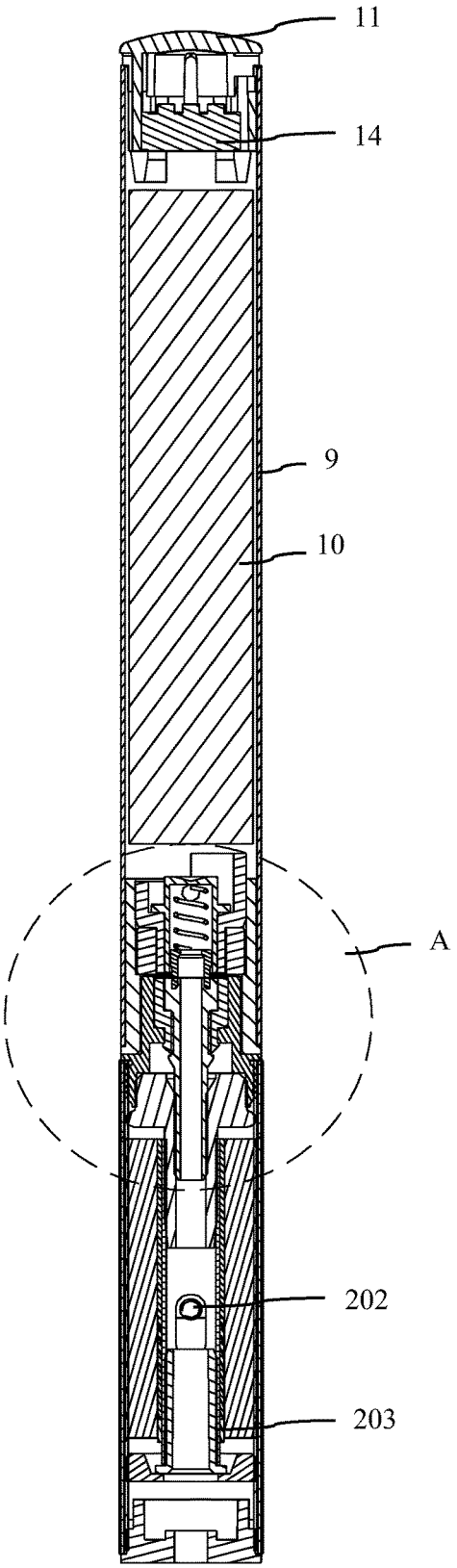
FIG. 7 is a structural schematic view of an electronic cigarette of a preferred embodiment of present invention.
Figure 8:
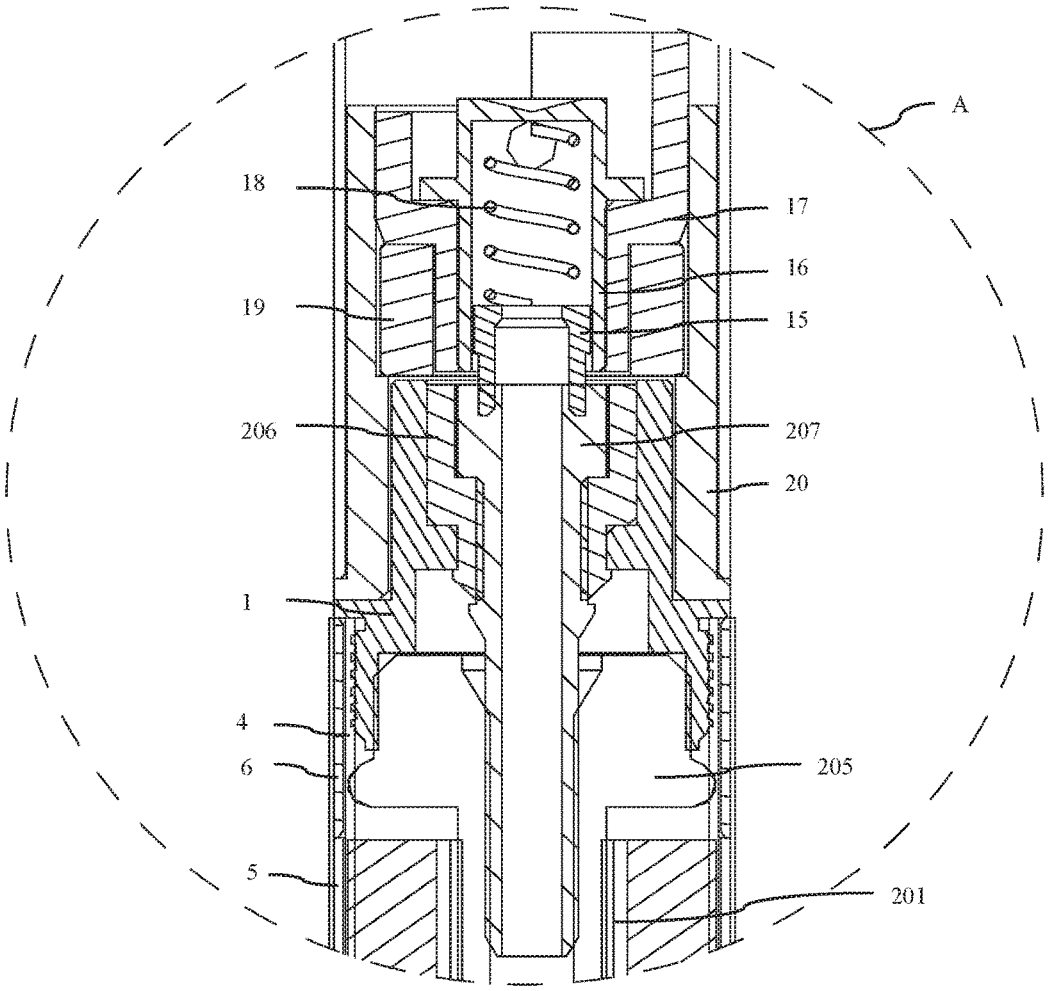
FIG. 8 is an amplifier schematic view of part A shown in FIG. 7.

As shown in FIG. 7, the present invention further provides an electronic cigarette, which comprises the atomization assembly for atomizing e-liquid and the battery assembly supplying power for the atomization assembly as above-mentioned.

The battery assembly of this embodiment comprises a battery sleeve 9, a battery 10 provided in the battery sleeve 9, an end cover 11 provided on one end of the battery sleeve 9 and a control module for controlling the atomization assembly to work. The battery 10 is connected electrically to the control module; a fastening sleeve 19 and a connection sleeve 20 for connecting with the atomization assembly, a battery electrode assembly for connecting electrically with the atomization electrode 207 and a stand 17 sleeved out the battery electrode assembly are provided on the other end of the battery sleeve 9.

The control module comprises an airflow sensor 14 provided in the end cover 11, the airflow sensor 14 is triggered when sensing the inhaling of the user and controls the battery 10 to supply power for the atomization assembly.

The battery electrode assembly comprises a battery electrode 15 connected electrically with the atomization electrode 207, an insulating cover 16 for isolating the battery electrode 15 from outside electrically, an elastic member 18 for connecting elastically the battery electrode 15 and the insulating cover 16; an accommodation space is provided in the insulating cover 16, the battery electrode 15 is provided compressibly in the accommodation space through the elastic member 18.

The connection sleeve 20 matched with the connection member 1 is inserted fixedly on one end of the battery sleeve 9, the connection sleeve 20 is connected stably with the battery sleeve 9 by an interference fit. The connection sleeve 20 is a hollow structure, one end of the connection sleeve 20 is inserted in the fastening sleeve 19, the battery electrode assembly is fixed in the fastening sleeve 19 and the fastening sleeve 19 is sleeved out the stand 17, the second connection end 102 of the connection member 1 is inserted in the other end of the connection sleeve 20.

In this embodiment, the connection member 1 is made of iron, the fastening sleeve 19 is made of magnetic materials which can attract the connection member 1, the stable connection between the battery assembly and the atomization assembly is realized by the adsorption force between the fixed sleeve 19 and the connection member 1. The magnetic connection in this embodiment is convenient for users to disassemble the electronic cigarette, the disassembly of the battery assembly and the atomization assembly can be finished just by pulling along the axial direction of the electronic cigarette towards two ends of the electronic cigarette, similarly, the connection of the battery assembly and the atomization assembly can be finished just by pressing along the axial direction of the electronic cigarette reversely, the operation is simple and convenient, a stability of the magnetic connection is high. In addition, the connection member 1 is made of conductive iron, it can be used as an electrode to supply power for the heating wire assembly 202 to simplify the structure of the atomization assembly.

Understandably, the connection between the battery assembly and the atomization assembly can be realized by a threaded structure, a buckle structure and so on, it is not limited here, this embodiment just shows a preferable implementation method. Because the thread structure and buckle structure will increase complexity of the product processing, and, with increasing times of using, the wear and tear will appear inevitably and will cause an unstable connection, and further affect a stability of the electrical connection between the atomization electrode and the battery electrode.

During an assembling process of the electronic cigarette, inserting the second connection end 102 of the connection member 1 into the connection sleeve 20, pressing tight along the axial direction of the electronic cigarette, the fastening sleeve 19 attracts the connection member 1 to connect the atomization assembly with the battery assembly, at the same time, the battery electrode 15 is inserted into the atomization electrode 207 under an action of the elastic member 18 to realize the electrical connection between the battery electrode 15 and the atomization electrode 207. When the atomization assembly is connected stably with the battery assembly, an end surface of the connection sleeve 20 abuts on the compression convex platform 103, which makes the compression convex platform 103 press tight downwards the end surface of the atomization sleeve 4 and the fastening ring 6.

The beneficial effects of implementation of the atomization assembly and the electronic cigarette of present invention are: the atomization sleeve 4 made of non-metallic materials and able to be elastically deformed under the external force is with light weight and simulates the soft feel of a real cigarette to improve the users' experience at the same time; the protective sleeve 5 also made of non-metallic materials can prevent the atomization sleeve 4 from damaging caused by abrasing or scratching by sharp instruments during using without affecting the elastic deformation of the atomization sleeve 5 at the same time; the knurled structure 104 make the interference fit between the connection member 1 and the atomization sleeve 4 be stronger, and increases the friction between the connection member 1 and the atomization sleeve 4 to prevent the connection member 1 from falling off from the atomization sleeve 4, the non-metallic elastic atomization sleeve 4 is sleeved on the connection member 1 through the metallic fastening ring 6, not only the structure is compact, the connection is also stable and reliable, solving the problems of easily cracking and falling off of the non-metallic atomization sleeve 4 when it is connected with the connection member 1; the recess 105 is configured for accommodating the spare mucilage to prevent the mucilage from spilling over and affecting appearance of the atomization assembly, the recess 105 is further configured for holding food grade silicone to prevent the e-liquid leaking, and the fastening ring 6 is pressed tight by the cooperating between the recess 105 and the compression convex platform 103 at the same time, which effectively prevents the atomization sleeve 4 from sliding outward to be damaged or to produce burr; the supporting member 203 inserted in the atomization core 2 can avoid the e-liquid leakage phenomenon when the atomization assembly is damaged under the extrusion force, or the deformation of the e-liquid retaining member 3 is too large under the clamping force of oral cavity which makes the e-liquid be pressed out, thus the user can use any tissue in the oral cavity such as teeth to force on the electronic cigarette of present invention when smoking, which improves the users' experience.

The embodiments of present invention are described above with combination of the figures, the concrete implementations above are just schematic but not restrictive, in the inspiration of the present application, those ordinary skills in the art can also make many modifications without breaking away from the subject of the present application and the protection scope of the claims. All these modifications belong to the protection of the present application.

What is claimed is:

1. An electronic cigarette, comprising an atomization assembly for atomizing e-liquid and a battery assembly for supplying power to the atomization;

wherein the atomization assembly comprises a connection member (1) for connecting to a battery assembly, an atomization core (2) for atomizing e-liquid, an e-liquid retaining member (3) for storing the e-liquid and made of oil absorption materials, and an atomization sleeve (4) made of non-metallic materials and able to be elastically deformed under an external force;

the connection member (1) comprises a first connection end (101) for inserting into the atomization sleeve (4), and a second connection end (102) for connecting to the battery assembly; a peripheral surface of an outer wall of the first connection end (101) is provided with a knurled structure (104) that prevents the atomization sleeve (4) from falling off, a compression convex platform (103) is convexly provided between the first connection end (101) and the second connection end (102), and a recess (105) extends along a periphery direction of a side of the compression convex platform (103);

the atomization core (2) comprises an atomization electrode (207) for electrically connecting to the battery assembly, an atomization core sleeve (201) inserted into the e-liquid retaining member (3), a heating wire assembly (202) electrically connected to the atomization electrode (207) and defined in the atomization core sleeve (201), and a supporting member (203) for reducing elastic deformation of the atomization assembly under the external force, the supporting member (203) is inserted on an end of the atomization core sleeve (201) which is opposite to the atomization electrode (207);

the atomization assembly further comprises a protective sleeve (5) sleeved outside the atomization sleeve (4) and a fastening ring (6) made of metallic materials and configured for fastening the atomization sleeve (4) to the connection member (1), the fastening ring (6) is positioned between the compression convex platform (103) and the protective sleeve (5);

wherein the battery assembly comprises a battery sleeve (9), a battery (10) provided in the battery sleeve (9), an end cover (11) provided on one end of the battery sleeve (9) and a control module for controlling the atomization assembly to work, the battery (10) is connected electrically to the control module; a fastening sleeve (19) for connecting with the atomization assembly and a battery electrode assembly for connecting electrically with the atomization electrode (207) are provided on the other end of the battery sleeve (9);

wherein the connection member (1) is made of conductive materials and is connected electrically to the heating wire assembly (202); and wherein the battery electrode assembly comprises a battery electrode (15) connected electrically with the atomization electrode (207), an insulating cover (16) for isolating the battery electrode (15) from outside electrically, an elastic member (18) for elastically connecting the battery electrode (15) and the insulating cover (16); an accommodation space is provided in the insulating cover (16), the battery electrode (15) is provided compressibly in the accommodation space via the elastic member (18).

2. The electronic cigarette according to claim 1, wherein the control module comprises an airflow sensor (14) defined in the end cover (11), the airflow sensor (14) is triggered when sensing an inhaling of users and controls the battery (10) to supply power to the atomization assembly.

3. The electronic cigarette according to claim 1, wherein the connection member (1) is made of iron, the fastening sleeve (19) is made of magnetic materials which can attract the connection member (1), and is configured for connecting the battery assembly with the atomization assembly through an adsorption force between the fastening sleeve (19) and the connection member (1).

* * * * *